US008032069B2

(12) United States Patent
Shin et al.

(10) Patent No.: US 8,032,069 B2
(45) **Date of Patent: *Oct. 4, 2011**

(54) FUSING DEVICE AND IMAGE FORMING APPARATUS HAVING THE SAME

(75) Inventors: Su-ho Shin, Seongnam-si (KR); Dong-woo Lee, Seoul (KR); Tae-gyu Kim, Hwasweong-si (KR); Chang-hoon Jung, Seoul (KR); Tae-hoon Kim, Suwon-si (KR); Hwan-hee Kim, Suwon-si (KR)

(73) Assignee: Samsung Electronics Co., Ltd, Suwon-si (KR)

( * ) Notice: Subject to any disclaimer, the term of this patent is extended or adjusted under 35 U.S.C. 154(b) by 0 days.

This patent is subject to a terminal disclaimer.

(21) Appl. No.: 12/975,785

(22) Filed: Dec. 22, 2010

(65) Prior Publication Data

US 2011/0091254 A1 Apr. 21, 2011

Related U.S. Application Data

(63) Continuation of application No. 12/036,514, filed on Feb. 25, 2008, now Pat. No. 7,881,650.

(30) Foreign Application Priority Data

Oct. 4, 2007 (KR) ..... 2007-99852

(51) Int. Cl.
*G03G 15/20* (2006.01)

(52) U.S. Cl. ..... 399/329

(58) Field of Classification Search ..... 399/329, 399/328; 219/216, 469–471
See application file for complete search history.

(56) References Cited

U.S. PATENT DOCUMENTS 5,742,878 A 4/1998 Kuroda
(Continued)

FOREIGN PATENT DOCUMENTS

JP 2006-251479 9/2006

OTHER PUBLICATIONS

European Search Report issued Jan. 23, 2009 in European Application No. 08156024.5.

(Continued)

*Primary Examiner* — Susan Lee
(74) *Attorney, Agent, or Firm* — Stanzione & Kim, LLP

(57) ABSTRACT

A fusing device includes a rotatable pressing roller, a fusing belt to rotate by a rotational force transmitted from the rotatable pressing roller, a nip forming member to contact an inner surface of the fusing belt to form a nip on a contact area between the rotatable pressing roller and the fusing belt, a heating member formed in approximately an internal central portion of the fusing belt to heat the nip forming member and the fusing belt, an inner support member formed within the fusing belt to press a nip part of the nip forming member toward the rotatable pressing roller, and an outer support member formed outside the fusing belt, and both ends of the outer support member being engaged with the inner support member to thereby reinforce the strength of the inner support member and form a path for radiation heat to disperse. The support unit includes an inner support member placed within the belt unit, and an outer support member placed outside the belt unit, both ends of the outer support member being engaged with the inner support member to reinforce the strength of the inner support member and to form a path for a radiation heat to disperse.

22 Claims, 14 Drawing Sheets

U.S. PATENT DOCUMENTS

| | | | | |
|---|---|---|---|---|
| 7,881,650 | B2 * | 2/2011 | Shin et al. | 399/329 |
| 2004/0062578 | A1 | 4/2004 | Kim et al. | |
| 2006/0177251 | A1 * | 8/2006 | Uehara et al. | 399/329 |

OTHER PUBLICATIONS

CN Office Action issued Jun. 21, 2011 in CN Patent Application No. 200810133972.2.

* cited by examiner

FUSING DEVICE AND IMAGE FORMING APPARATUS HAVING THE SAME

CROSS-REFERENCE TO RELATED APPLICATIONS

This application is a Continuation Application of U.S. application Ser. No. 12/036,514, filed on Feb. 25, 2008, now U.S. Pat. No. 7,881,650 in the U.S. Patent and Trademark Office, which claims priority under 35 U.S.C. §119(a) from Korean Patent Application No. 2007-99852, filed Oct. 4, 2007, in the Korean Intellectual Property Office, the entire disclosure of which is hereby incorporated in its entirety by reference.

BACKGROUND OF THE INVENTION

1. Field of the Invention

The present general inventive concept relates to an image forming apparatus, and more particularly, to a belt type fusing device of an improved structure to fix a developer image onto a recording medium, and an image forming apparatus having the same.

2. Description of the Related Art

Electrophotographic image forming apparatuses, such as printers, copiers, or multi-function units, generally adopt a fusing device which fixes a developer image into a recording medium with heat and pressure. Among various fusing devices, roller and belt types of fusing devices are generally used.

The main technical requirements of a fusing device include speedy warm-up and endurable fusing result. A heating source of less heat capacity is more efficient for a fast warm-up. Performance of toner fixation mainly depends on temperature, pressure, and width of nip area. In a temperature range between cold offset and hot offset, the higher temperature ensures better fixability. Also the higher pressure and wider nip area help provide better fixability.

FIG. 1 illustrates a conventional roller type fusing device. As illustrated, the conventional roller type fusing device includes a pressing roller 10 and a heating roller 20 rotating in tight contact with each other, and a heating member 30 housed inside the heating roller 20. Because the heating member 30 has high heat capacity, and the heating member 30 heats the whole area of the pressing roller 20, a warm-up takes a longer time, while a relatively narrow nip area is formed on the contact areas between the pressing roller 10 and the heating roller 20.

FIG. 2 illustrates a conventional belt type fusing device proposed to improve a warm-up speed. The fusing device includes a pressing roller 10, a fusing belt 40 to rotate with a rotational force transmitted from the pressing roller 10, a guide member 50 provided within the fusing belt 40 to guide the rotation of the fusing belt 40, and a heating member 60 formed on the guide member 50 to heat a nip area (N) created on the fusing belt 40.

Such a belt type fusing device employs the heating member 60 of a relatively low heat capacity. Also, the belt type fusing device locally heats the nip areas (N). Accordingly, the belt type fusing device has a shorter warm-up time and wider nip area (N). However, because the heating member 60 is housed at the nip areas (N) against which the pressing roller 10 is squeezed, the pressing roller 10 is required to generate a limited pressing force that the heating member 60 can endure. Because the pressing force is limited in the nip areas (N), unsuccessful fixation may occur due to lack of pressing force. However, the pressing force cannot be increased in the nip areas (N), because the heating member 60 can be damaged by the pressure and heat deformation.

SUMMARY OF THE INVENTION

The present general inventive concept provides a fusing device capable of reducing a warm-up time and subsequently providing speedy printing.

The present general inventive concept also provides a fusing device capable of increasing an effective width of a nip area, increasing a pressure, and subsequently improving image fixing performance.

The present general inventive concept also provides an image forming apparatus having a fusing device to ensure a speedy warm-up and a stable heating characteristic.

Additional aspects and utilities of the present general inventive concept will be set forth in part in the description which follows and, in part, will be obvious from the description, or may be learned by practice of the general inventive concept.

The foregoing and/or other aspects and utilities of the present general inventive concept may be achieved by providing a fusing device, which includes a pressing unit, a belt unit to rotate in contact with the pressing unit, an outer surface of the belt unit contacting the pressing unit, a nip forming unit in contact with the pressing unit to form a nip area on a contact area between the pressing unit and the belt unit, an inner surface of the nip forming unit contacting the belt unit, a heating unit to heat the nip forming unit and the belt unit, and a support unit to press the nip forming unit, the support unit comprising a space formed therein for the belt unit to disperse through.

The pressing unit may include a rotatable roller member, and the belt unit rotates by a rotating force transmitted from the roller member.

The nip forming unit may include a main body formed to wrap around the heating unit partially or entirely to collect radiation heat from the heating unit, and a nip part connected to the main body, the nip part to contact the belt unit. The main body may include a slit to allow the radiation heat of the heating unit to be directly transferred to the nip part. The main body and the nip part may be integrally formed with each other. A part of the nip part that faces the pressing unit may be curved to correspond to the shape of an outer circumference of the pressing unit.

The support unit may include an inner support member placed within the belt unit, and an outer support member placed outside the belt unit, both ends of the outer support member being engaged with the inner support member to reinforce the strength of the inner support member and to form a path for a radiation heat to disperse. The nip forming unit may include a main body and a nip part, and the inner support member may include a central portion comprising a pair of spaced ribs to press both sides of the nip part, and an arch-shape connector to connect both ends of each of the pair of spaced ribs. The central portion may further include reinforcing ribs bent toward the inner side of the outer side of the pair of spaced ribs. The inner support member may further include a plurality of spacers disposed between the pair of spaced ribs to keep the pair of spaced ribs at a predetermined distance from each other.

The support unit may further include guide members provided on both ends of the support unit to guide the traveling of the belt unit. The guide members may be disposed between arch-shape connectors of the inner support member and both ends of the outer support member and fastened in place by screws respectively. Both ends of the outer support member may contact the arch-shape connector of the inner support member. Both ends of the outer support member may be bent and fastened.

The space of the support unit may be sized to be at least as long as the belt unit in the direction of axis.

The fusing device may further include an insulating member disposed between the nip part of the nip forming unit and the central portion of the inner support member to prevent transfer of heat of the nip forming unit to the support unit. A surface of the insulating member that contacts the belt unit may be round processed.

The main body of the nip forming unit may include a heat shielding part to prevent transfer of radiation heat of the heating unit to the inner support member and the insulating member.

The fusing device may further include a thermostat formed on a cover of the fusing device to detect, by contact or without contact, the temperature of the belt unit and shut off power when detecting overheating, and wherein the outer support member of the support unit comprises a spot for the thermostat to detect the temperature.

The foregoing and/or other aspects and utilities of the present general inventive concept may be achieved by providing a fusing device, which includes a rotatable pressing roller, a fusing belt to rotate by a rotational force transmitted from the rotatable pressing roller, a nip forming member contacting an inner surface of the fusing belt to form a nip on a contact area between the rotatable pressing roller and the fusing belt, a heating member formed in approximately an internal central portion of the fusing belt to heat the nip forming member and the fusing belt, an inner support member formed within the fusing belt to press a nip part of the nip forming member toward the rotatable pressing roller, and an outer support member formed outside the fusing belt, and both ends of the outer support member being engaged with the inner support member to thereby reinforce the strength of the inner support member and form a path for radiation heat to disperse.

The foregoing and/or other aspects and utilities of the present general inventive concept may also be achieved by providing an image forming apparatus, which includes a photosensitive medium to form an electrostatic latent image thereon, a developing unit to develop the electrostatic latent image on the photosensitive medium with a developer, a transfer unit to transfer a developer image of the photosensitive medium onto a recording medium, and a fusing device to fix the developer image into the recording medium.

The foregoing and/or other aspects and utilities of the present general inventive concept may also be achieved by providing a fusing device, including a pressing unit, a belt unit to rotate in contact with the pressing unit, a nip forming unit disposed to form a nip area on a contact area between the pressing unit and the belt unit, a heating unit to heat the nip forming unit and the belt unit; a support unit to support the nip forming unit with respect to the pressing unit, and an insulating member disposed between the nip forming unit and the support unit to prevent transfer of the heat from the nip forming unit to the support unit.

The heating unit may be spaced-apart from the nip forming unit and the support unit.

The nip forming unit may be disposed between the heating unit and the belt unit to directly and indirectly receive heat from the heating unit.

The nip forming unit may include a main body to surround at least a portion of the heating unit to receive a first portion of heat from the heating unit, and a nip part connected to the main body and disposed on the nip area to receive a second portion of the heat from the heating unit.

The first portion of heat of the heating unit may be transmitted to the nip part, and the second portion of heat of the heating unit may be directly transmitted from the heating unit to the nip part.

The nip forming unit may include a main body to receive a first portion of the heat from the heating unit, and a nip part having a first portion to receive the first portion of the heat of the heating unit from the main body and a second portion to directly receive a second portion of the heat of the heating unit.

The nip forming unit may include a main body to surround a first portion of the heating unit to receive a first portion of heat of the heating unit, and a nip part to surround a second portion of the heating unit to receive a second portion of heat of the heating unit.

The belt unit may surround a third portion of the heating unit to receive a third portion of heat of the heating unit.

The main body may include a portion to provide a passage through which the second portion of heat of the heating unit is directly received by the nip part.

The portion of the main body may transmit the first portion of the heat to the nip part.

The main body may be spaced-apart from the heating unit by a first distance, and the nip part may be spaced-apart from the heating unit by a second distance longer than the first distance to form the nip area between the belt and the pressing unit.

The nip forming unit may be disposed between the heating unit and the support unit to prevent direct-transmission of the heat from the heating unit to the support unit.

The support unit may include an inner support member disposed inside a traveling path of the belt unit to support the nip forming part, and an outer support member disposed outside the traveling path of the belt unit and connected to the inner support member to support the inner support member with respect to a reference frame of the fusing unit.

The support unit may include an inner support member disposed to support the nip forming part to be spaced-apart from the heating unit, and an outer support member disposed outside the belt unit to support the inner support member with respect to the pressing unit.

The insulating member may include a first portion disposed between the nip forming unit and the support unit to provide a heat insulation, and a second portion extended from the first portion to guide the belt unit along a traveling path.

The foregoing and/or other aspects and utilities of the present general inventive concept may also be achieved by providing a fusing device, including a pressing unit, a belt unit to rotate in contact with the pressing unit, a nip forming unit to be in contact with the pressing unit to form a nip area on a contact area between the pressing unit and the belt unit, a heating unit to heat the nip forming unit and the belt unit, a support unit to support the nip forming unit with respect to the pressing unit, the support unit having a space formed therein, so that the belt unit passes through the space of the support unit, and an insulating member disposed between the nip forming unit and the support unit to prevent transfer of the heat from the nip forming unit to the support unit.

The foregoing and/or other aspects and utilities of the present general inventive concept may also be achieved by providing an image forming apparatus including an image forming unit to form an image on a printing medium, and a fusing device to fix the image onto the recording medium, and the fusing device may include a pressing unit, a belt unit to rotate in contact with the pressing unit, a nip forming unit disposed to form a nip area on a contact area between the pressing unit and the belt unit, a heating unit to heat the nip forming unit and the belt unit, a support unit to support the nip forming unit with respect to the pressing unit, and an insulating member disposed between the nip forming unit and the support unit to prevent transfer of the heat from the nip forming unit to the support unit.

The foregoing and/or other aspects and utilities of the present general inventive concept may also be achieved by providing an image forming apparatus including an image forming unit to form an image on a printing medium, and a fusing device to fix the image onto the recording medium, and the fusing device may include a pressing unit, a belt unit to rotate in contact with the pressing unit, a nip forming unit to be in contact with the pressing unit to form a nip area on a contact area between the pressing unit and the belt unit, a heating unit to heat the nip forming unit and the belt unit, a support unit to support the nip forming unit with respect to the pressing unit, the support unit having a space formed therein, so that the belt unit passes through the space of the support unit, and an insulating member disposed between the nip forming unit and the support unit to prevent transfer of the heat from the nip forming unit to the support unit.

BRIEF DESCRIPTION OF THE DRAWINGS

These and/or other aspects and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
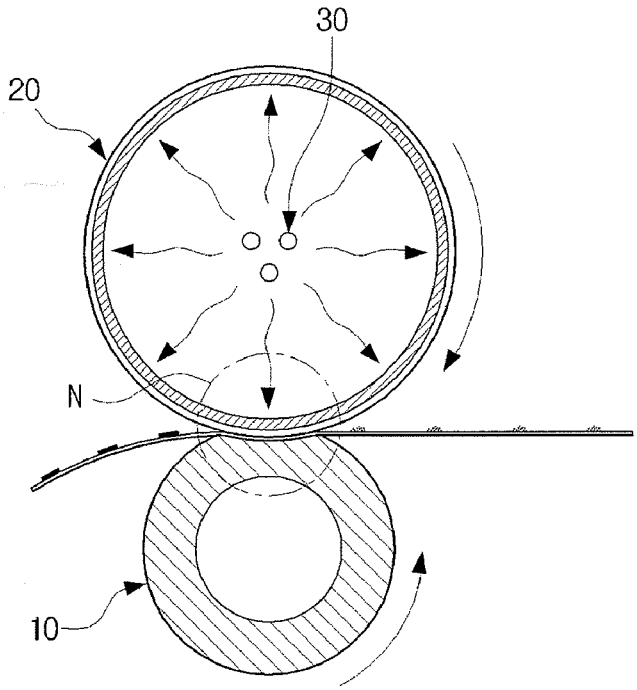
FIG. 1 (PRIOR ART)
FIG. 1 is a cross-section view illustrating a conventional roller type fusing device.
Figure 2:
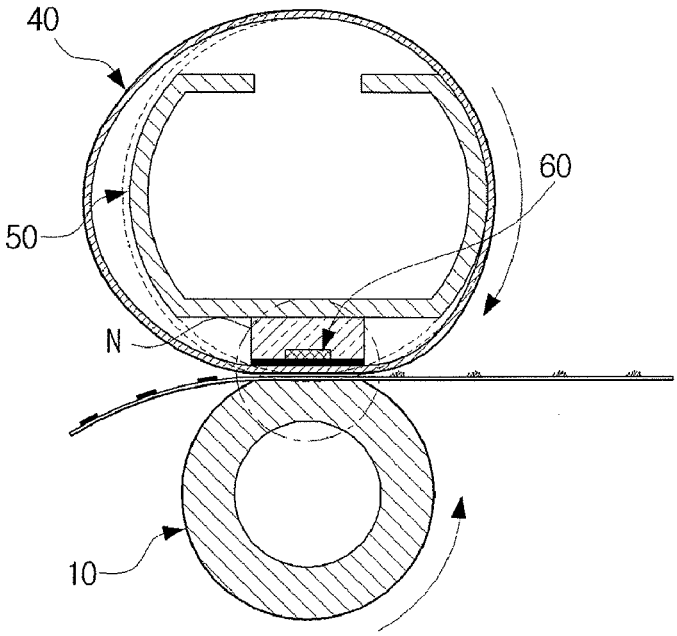
FIG. 2 (PRIOR ART)
FIG. 2 is a cross-section view illustrating a conventional belt type fusing device.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 3:
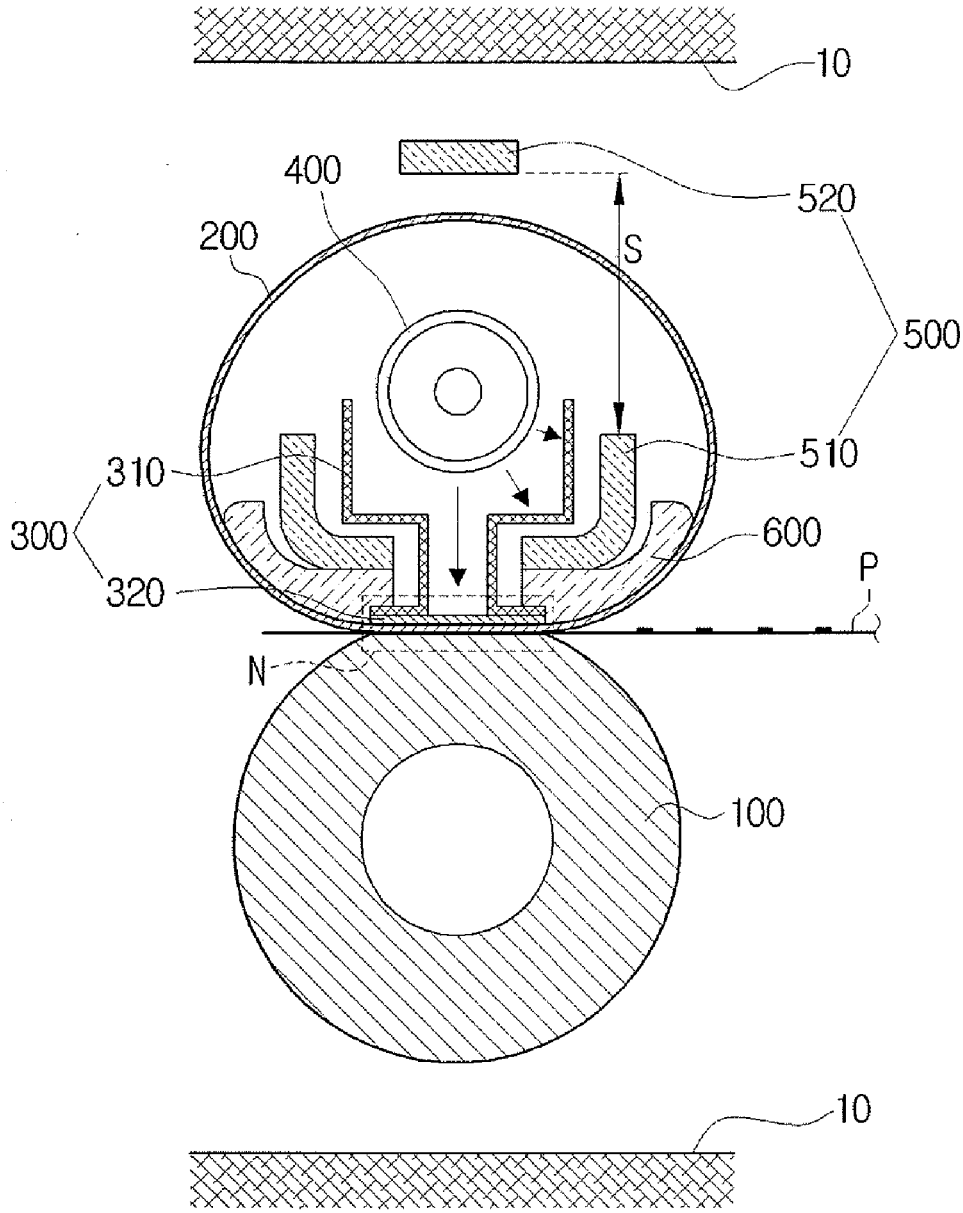
FIG. 3 is a cross-section view illustrating a fusing device according to an exemplary embodiment of the present general inventive concept.
Figure 4:
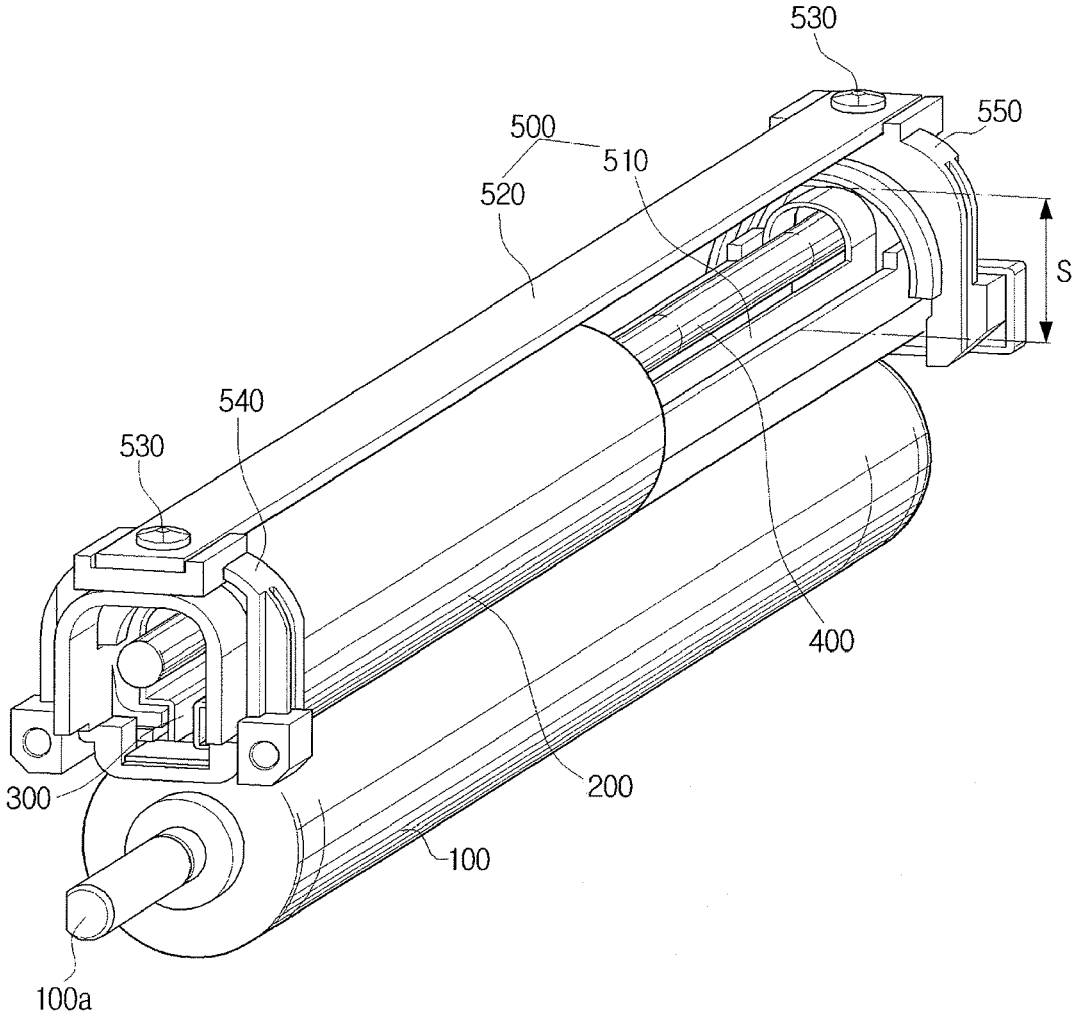
FIG. 4 is a perspective view illustrating the fusing device of FIG. 3.

Referring to FIGS. 3 and 4, a fusing device according to an exemplary embodiment of the present general inventive concept includes a pressing unit 100, a belt unit 200 to rotate in contact with the pressing unit 100 at an outer surface thereof, a nip forming unit 300 in contact with an inner surface of the belt unit 200 to form a nip area (N) on a contact between the pressing unit 100 and the belt unit 200, a heating unit 400 to heat the nip forming unit 300 and the belt unit 200, and a support unit 500 to press the nip forming unit 300 toward the pressing unit 100 and having a space S through which the belt unit 200 is passed.

The pressing unit 100 forms the nip area (N) with the belt unit 200, and includes an elongated cylindrical roller member to push a recording medium (P) against the belt unit 200. Although the roller member is implemented as the pressing unit 100 in this example, other forms of pressing unit 100, such as a belt type or pad type, can be also applied. However, a roller type may be desirable for the pressing unit 100 to prevent a slippage of a recording medium during conveyance.

Although not illustrated, an elastic member may be provided between a rotating shaft 100*a* of the pressing unit 100 and a fusing device frame 10 to elastically support the pressing unit 100 toward the belt unit 200 with respect to the fusing frame 10.

The belt unit 200 includes a fusing belt to travel along a rotating (traveling) path by a rotational force transmitted from the pressing unit 100. The belt unit 200 has a longer length than the pressing unit 100 at an outer circumference thereof in a direction perpendicular to the rotating (traveling) direction, and is made of a heat-resistant material. For example, the belt unit 200 may have a single-layer structure made of a metal, such as SUS or nickel, or a heat-resistant polymer, such as polyimide. Alternatively, the belt unit 200 may have a multi-layer structure. For example, a metal or heat-resistant polymer belt may be added with an elastic layer made of a silicone or rubber on an outer circumference thereof to perform or improve a color printing process of an image forming apparatus. The belt unit 200 may also have a black coating layer on an inner circumference to facilitate absorption of radiation heat, or a Teflon resin coating layer on the inner or outer circumference to serve as an abrasion resistant layer. A lubricant may be applied over the inner surface of the belt unit 200 to facilitate the traveling of the belt unit 200.

A predetermined degree of pressure is necessary between the pressing unit 100 and the belt unit 200 to fix a developer image into a recording medium P. The pressure is applied uniformly in a length direction of the belt unit 200 in a rotating (traveling) direction by the support unit 500. While the exemplary embodiment exemplifies that the belt unit 200 is passive-driven by the pressing unit 100, a separate driving device may also be implemented to drive the belt unit 200. Alternatively, the belt unit 200 may be driven, and the pressing unit 100 is passive-driven by the belt unit 200.

The nip forming unit 300 includes a main body 310 to receive or collect the radiant heat from the heating unit 400, and a nip part 320 to form the nip area N formed on a contact between the pressing unit 100 and the belt unit 200. The main body 310 may be disposed to wrap around or surround a portion or an entirety of the heating unit 400, so as to receive or collect not only the radiant heat from the heating unit 400, but also the radiant heat reflected from other structures, such as an inner surface of the belt unit 200. The collected heat energy is transmitted to the nip part 320. The main body 310 may include one or more slits or gaps 310*a* to allow the radiant heat from the heating unit 400 to be passed and directly transmitted to the nip area 320. The nip forming unit 300 may be made of highly heat-transferable materials, such as metals including aluminum or copper, or alloy of metals.

The heat generated from the heating unit 400 includes a first portion of the heat directly transmitted to the nip part 320, and a second portion of the heat indirectly transmitted to the nip part 320. In the direct transmission of the heat, the nip part 320 receives the first portion of the heat from the heating unit 400, and in the indirect transmission of the heat, the main body 310 receives the second portion of the heat and transmits the received second portion of the heat to the nip part 320. It is possible that the main body has portions spaced-apart from each other to provide a passage (gap) through which the first portion of the heat of the heating unit passes through to be transmitted to the nip part 320.

Figure 5A:
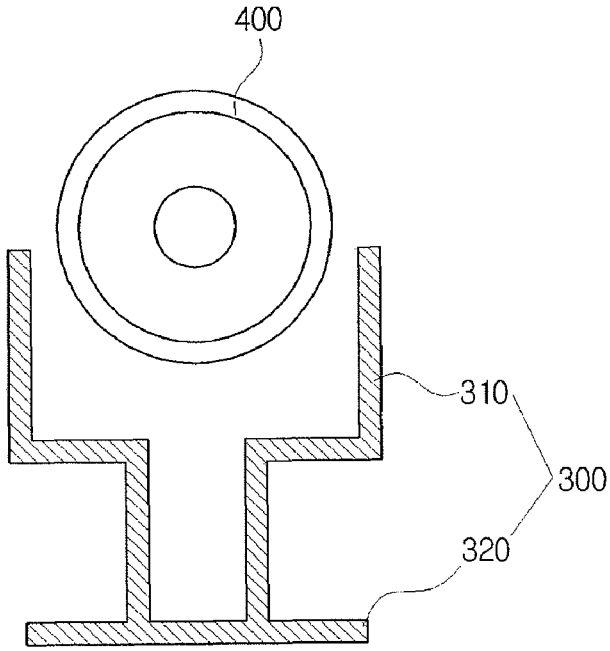
FIGS. 5A and 5B are cross-section views of a nip forming unit of the fusing device of FIG. 3 according to different examples, respectively.
Figure 5B:
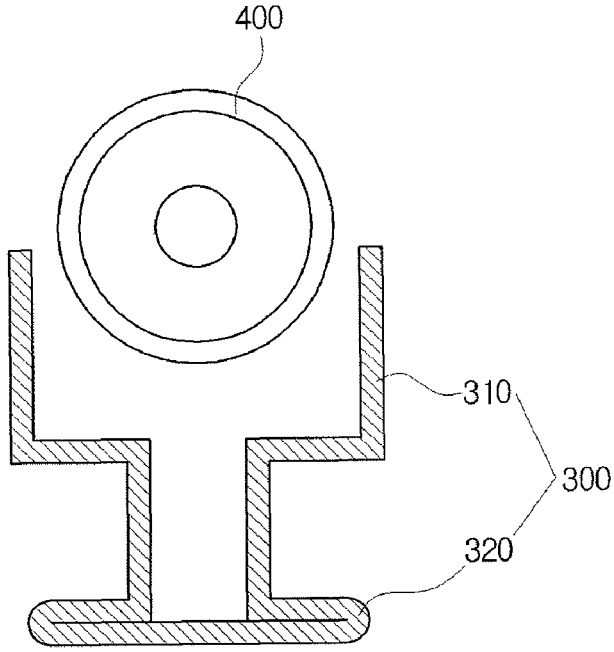

While the exemplary embodiment illustrated in FIG. 3 implements the nip forming unit 300 having the nip part 320 and the main body 310 prepared separately and engaged with each other, the main body 310 and the nip part 320 may be integrally formed with each other to decrease the thermal resistance by contact as illustrated in FIGS. 5A and 5B. FIG. 5A illustrates a nip forming unit 300 formed by press processing, and FIG. 5B illustrates a nip forming unit 300 formed by bending a metal plate. Although not illustrated, a surface of the nip part 320 that faces the pressing unit 100 may be curved to ensure tight contact with the recording medium P and thus to increase image fixability. That is, the nip part 320 includes a first portion having a shape to correspond to the nip area N or the pressing unit 100, and a second portion extended from the first portion to have a shape to correspond to the rotating or traveling path of the belt unit 200.

The heating unit 400 may be placed approximately at a center of an inner space defined within the belt unit 200. Accordingly, the heating unit 400 is put in a position to allow radiation heat to be directly transmitted to at least a portion of the inner surface of the belt unit 200 and to at least a portion of the nip forming unit 300. The heating unit 400 generates heat with the power received from an outside of the fusing unit or a component of the image forming apparatus, to heat the nip forming unit 300 and also the belt unit 200. The heating unit 400 may be implemented as a lamp heater, a hot wire, or a plane heater having a resistance pattern. The heating unit 400 may be implemented as a cylindrical halogen lamp. Although not illustrated, the fusing device may include a temperature sensor to be positioned on at least one of the belt unit 200, the nip forming unit 300, the heating unit 400, and the support unit 500 to detect a temperature thereof, and a temperature controller to control an amount of heat radiation of the heating unit 400 based on the temperature detected by the temperature sensor to maintain the temperature of the fusing device at a predetermined degree.

The support unit 500 has a predetermined degree of strength to support and press the nip part 320 of the nip forming unit 320 with respect to the pressing unit 100. The support unit 500 may be made of a material having a high strength, such as a metal of stainless or spring steel having a high strength. The support unit 500 supports the nip forming unit 300, and supports particularly the nip part 320 from both sides thereof and squeezes or pushes the nip part 320 against the pressing unit 100 to create a constant nip area along a length direction perpendicular or parallel to the rotating (traveling) direction of the belt unit 200. The support unit 500 is disposed on the fusing device frame 10 of the image forming apparatus, and a concentrated load is generated on both ends of the support unit 500 due to a returning force of an elastic element, such as a spring (not illustrated) disposed between the fusing device frame 10 and the support unit 500. Because the support unit 500 with the predetermined strength is squeezed or pushed evenly along a longitudinal axis direction of the nip forming unit 300 or a rotating (traveling) direction of the belt unit 200, the nip area N and the pressing force can be maintained uniform. As a result, better fixability is provided.

Meanwhile, it is not easy to generate a force to evenly press the nip forming unit 300 if the support unit 500 has less strength, because bends occur. In order to restrict or prevent bending deflection by the force exerted on both ends of the support unit 500, the support unit 500 is required to have a predetermined bending strength. The moment of inertia of a cross sectional area is also required to be large enough, to support and squeeze (push) the nip forming unit 300 disposed inside the belt unit 200. Accordingly, the support unit 500 is arranged inside the belt unit 200 entirely or at least partially. When an entire portion of the support unit 500 is arranged inside the belt unit 200, the radiation heat of the heating unit 400 can affect the entire portion of the support unit 500, thereby affecting a warm-up speed. Furthermore, as the support unit 500 is placed inside the belt unit 200, the support unit 500 can be heated directly or indirectly by the radiation heat of the heating unit 400 and thermally deformed. However, the presence of the heating unit 400 inside the belt unit 200 and space limit make temperature control difficult.

In order to solve these problems, an exemplary embodiment of the present general inventive concept forms a space S in a portion of the support unit 500 and disposes the belt unit 200 to run through the space S of the support unit 500. The space S may have a length longer than the length of the belt unit 200 and a height higher than a thickness of the belt unit 200 or a height of the belt unit in a direction perpendicular to a rotation direction of the belt unit 200 so as to prevent interference between the belt unit 200 and the support unit 500 having two portions disposed inside and outside the belt unit 200.

In other words, at least a portion of the support unit 500 is placed inside the belt unit 200, while the remaining portion is placed outside the belt unit 200. Because a considerable area of the belt unit 200 is directly exposed to the heating unit 400, the belt unit 200 or the nip forming unit 300 can receive uninterrupted radiation heat from the heating unit 400. As a result, the belt unit 200 can be warmed up rapidly. Furthermore, because a moment of inertia of cross sectional area is ensured to increase the bending strength, an external heat radiation passage is provided in the belt unit 200, thereby restricting and/or preventing the bending of the support unit 500 by overheating. As a result, formation of a constant nip area is ensured.

Figure 6:
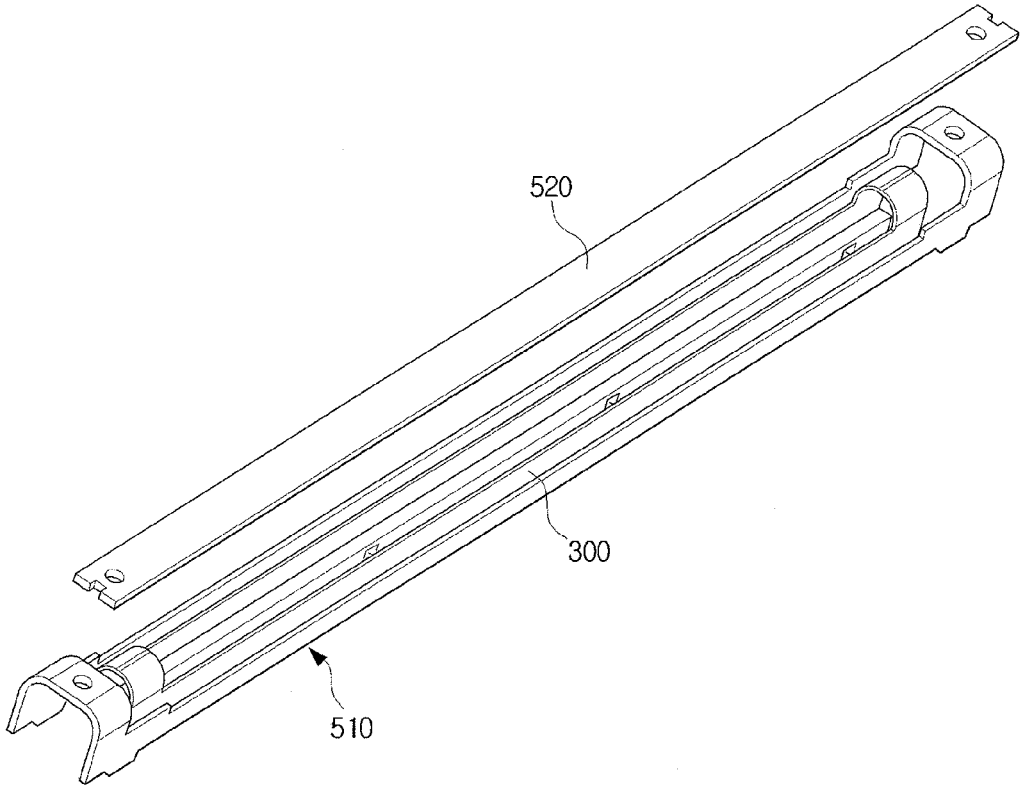
FIG. 6 is a perspective view illustrating the nip forming unit and a support unit of the fusing device of FIG. 3.

Referring to FIGS. 3 and 4, the support unit 500 includes an inner support member 510 formed inside the belt unit 200, and an outer support member 520 formed outside the belt unit 200. Both ends of the outer support member 520 are engaged with both ends of the inner support member 510 by a fastening element such as a screw 530. Referring to FIG. 6, the nip forming part 300, the inner support member 510, and the outer support member 520 are disposed to be assembled with respect to the heating unit 400, so that the belt unit 200 is disposed between the longitudinal side of the inner and outer support members 510 and 520 and the both ends of the inner and outer support members 510 and 520. As a result, the strength of the inner support member 510 is reinforced, and the radiation passage is provided.

Figure 7:
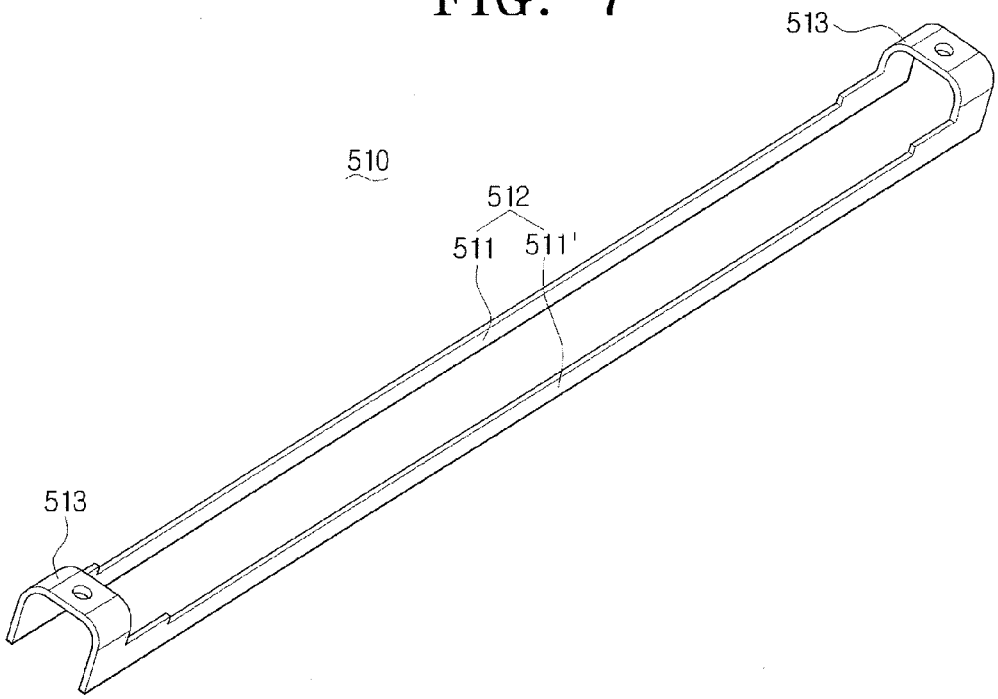
FIG. 7 is a perspective view illustrating an internal support member that constitutes the support unit of the fusing device of FIG. 3.

Referring to FIG. 7, the inner support member 510 includes a central portion 512 having a pair of spaced ribs 511 and 511' to press both sides of the nip part 320, and an arch-shape connector 513 to link both ends of the pair of spaced ribs 511 and 511'.

Figure 8:
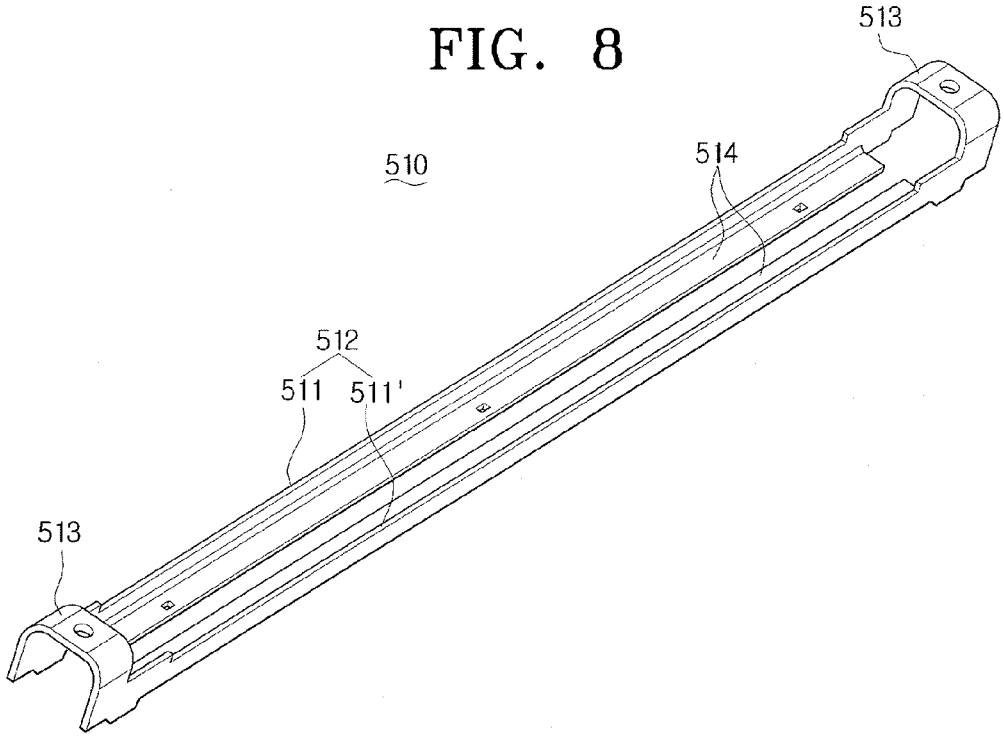
FIG. 8 is a perspective view illustrating an internal support member of the fusing device of FIG. 3 according to another exemplary embodiment of the present general inventive concept.

Referring to FIG. 8, the inner support member 510 may additionally include bent reinforcing ribs 514 formed on inner or outer sides of the pair of spaced ribs 511 and 511'. The bent reinforcing ribs 514 help increase the moment of inertia of a cross sectional area within a predetermined range of area.

Figure 9:
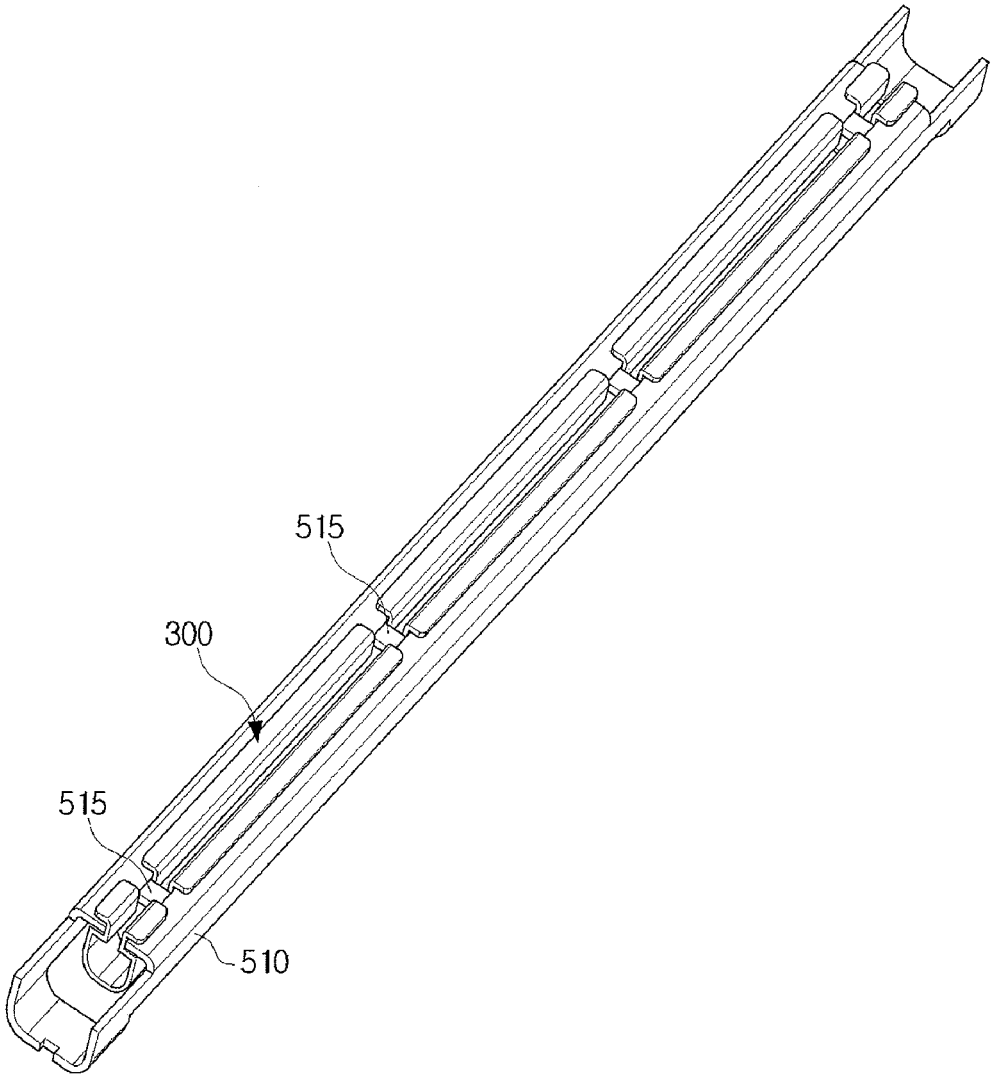
FIG. 9 is a rear perspective view illustrating an internal support member of the fusing device of FIG. 3 according to yet another exemplary embodiment of the present general inventive concept.

Referring to FIG. 9, the inner support member 510 includes a plurality of spacers 515 to formed between the pair of spaced ribs 511 and 511' to keep a constant gap between the ribs 511 and 511'. The inner support member 510 may be deformed by a load exerted on both ends, causing the gap between the spaced ribs 511 and 511' to be reduced or changed and the subsequent bending of the nip forming unit 300 fit in the gap. By placing one or more spacer 515 between the spaced ribs 511 and 511' of the inner support member 510, such reduction or change of the gap between the spaced ribs 511 and 511' can be prevented. Because the spacers 515 are put in place after the nip forming unit 300 is fit in the inner support member 510, the nip forming unit 300 may be partially deformed by cutting, for example, to provide a space for the spacers 515.

Referring to FIG. 4, the support unit 500 may further include guide members 540 and 550 formed on both ends thereof to guide the movement of the belt unit 200 therebetween. The guide members 540 and 550 are fastened as one end of each guide member 540 or 550 is fit in between the outer support member 520 and the arch-shape connector 513 or the inner support member 510 and is fastened by a screw 530 in place. The guide members 540 and 550 may be made out of heat-resistant resin, and supported on the fusing device frame 10.

Referring back to FIGS. 3 and 4, the fusing device includes an insulating member 600 disposed between the nip part 320 of the nip forming unit 300 and the inner support member 510 of the support unit 500 to block the transfer of heat from the nip part 320 to the inner support member 510. The insulating member 600 may implement a low heat conductive material, such as rubber, resin, ceramic, or polymer. The insulating member 600 controls the transfer of heat from the nip part 320 of the nip forming unit 300 to the inner support member 510 in an initial warm-up stage, thereby preventing increase of a warm-up time.

Referring to FIG. 3, the insulating member 600 contacts the nip part 320 of the nip forming unit 300, and pressed by the inner support member 510 of the support unit 500. A surface of the insulating member 600 that contacts the belt unit 200 is curved to allow smooth traveling of the belt unit 200.

Accordingly, the insulating member 600 includes one end disposed to support the nip part 320 with respect to the inner support member 510 and the other end extended from the one end toward the belt unit 200 and having a shape to correspond to the rotating (traveling) path of the belt unit 200. The shape of the other end of the insulating member 600 may be a curved shape to correspond to a portion of the belt unit formed along the rotating (traveling) path.

Figure 10:
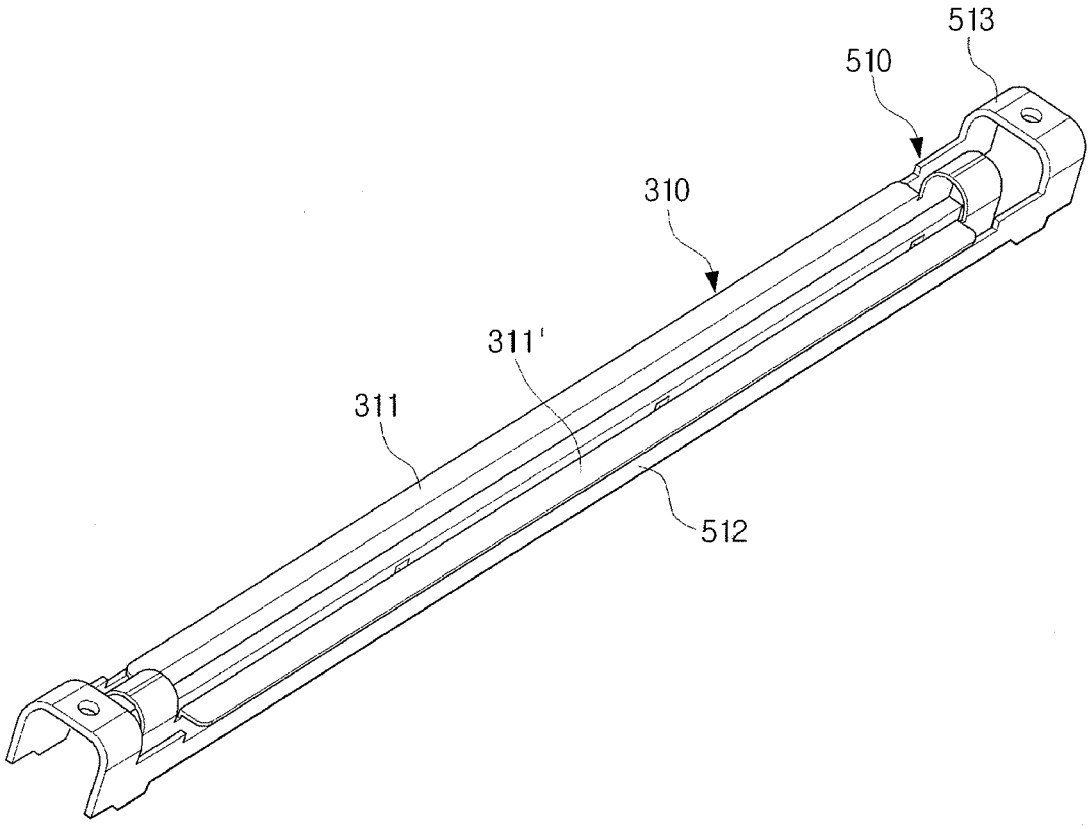
FIG. 10 is a perspective view illustrating a nip forming unit of the fusing device of FIG. 3 according to yet another exemplary embodiment of the present general inventive concept.
Figure 11:
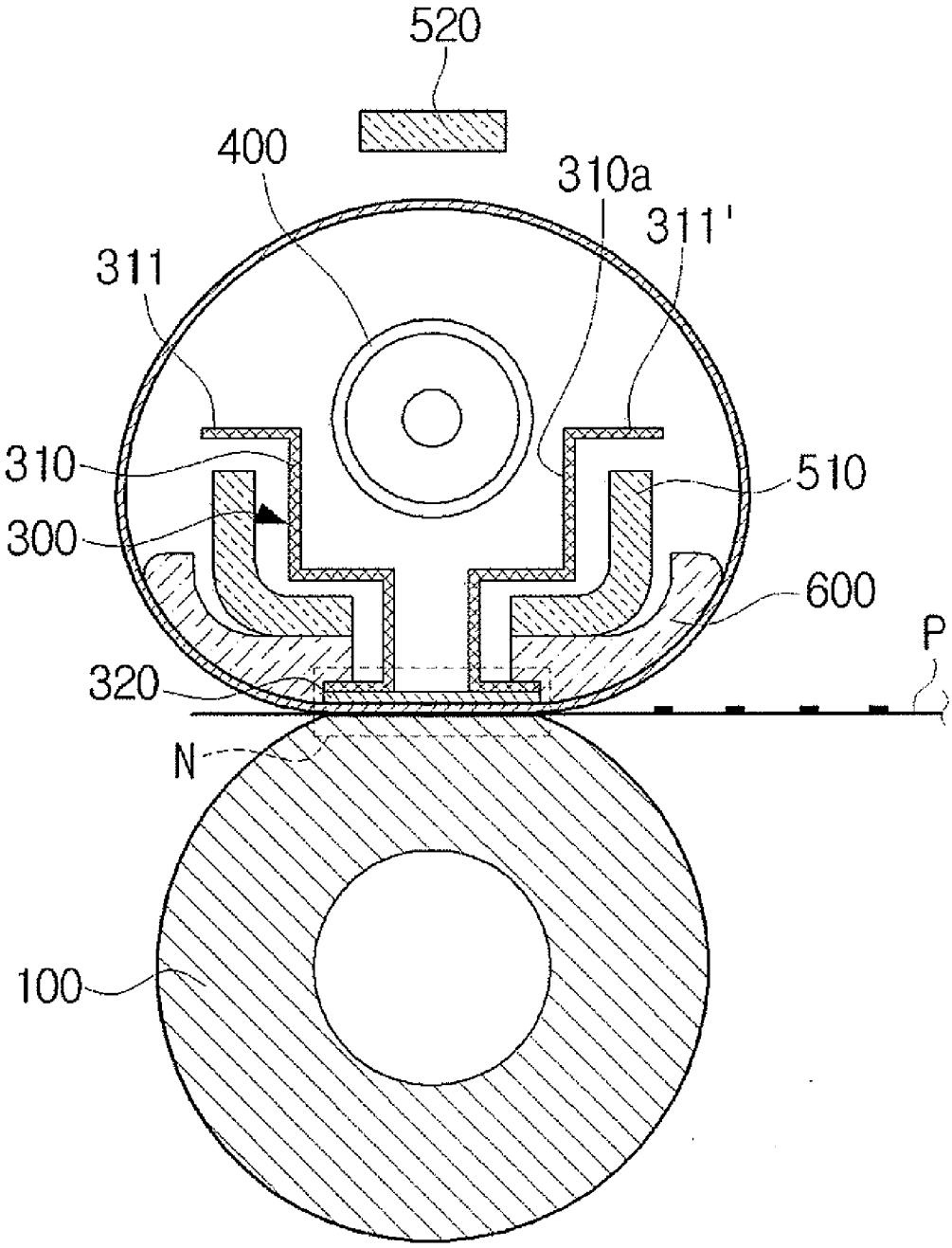
FIG. 11 is a cross-section view illustrating a fusing device employing the nip forming unit of FIG. 10.

Referring to FIGS. 10 and 11, the main body 310 of the nip forming unit 300 includes heat shielding units 311 and 311' extended from corresponding bodies **310*a* to prevent the direct transfer of the radiation heat of the heating unit 400 to the inner support member 510 and the insulating member 600. Because the heat shielding units 311 and 311' prevent the direct transfer of the radiation heat of the heating unit 400 to the inner support member 510 or the insulating member 600, overheating of the inner support member 510 and the insulating member 600 is avoided. While the heat shielding units 311 and 311' are bent in perpendicular relation with respect to the main body 310 in the exemplary embodiment explained above, other alternative shapes, such as diagonal shape, may be implemented to prevent the direct transfer of the heat. The bodies 310*a* and the heat shielding unit 311 or 311' has a shape to correspond to a shape of the inner support member 510 to surround the inner support member 510**.

Figure 12:
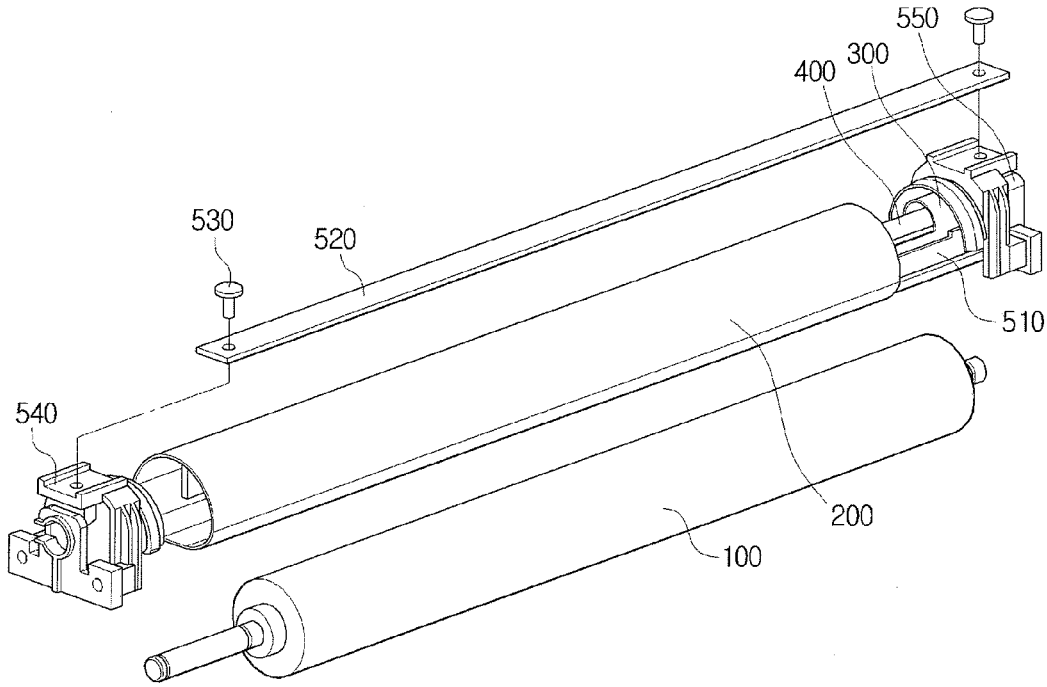
FIG. 12 is a perspective view illustrating a fusing device in an assembled state according to an exemplary embodiment of the present general inventive concept.

Referring to FIG. 12, the fusing device according to the exemplary embodiment of the present general inventive concept is constructed by engaging the nip forming unit 300 with the inner support member 510, engaging the belt guide member 550 with one side of the inner support member 510, engaging the belt unit 200 from the other side of the inner support member 510, engaging the belt guide member 540 with the other side of the inner support member 510 assembled with the belt unit 200, placing the outer support member 520 on both guide members 540 and 550, and assembling the inner support member 510, the outer support member 520 and the guide member 540 altogether with screws 530.

In the fusing device constructed as explained above according to the exemplary embodiment of the present general inventive concept, the inner support member 510 of the support unit 500 to press the nip forming unit 300 is arranged within the belt unit 200, and the outer support member 520 to reinforce the strength of the inner support member 510 is arranged outside the belt unit 200. Because no obstacle exists in the path for transferring radiation heat between the heating unit 400 and the belt unit 200, the belt unit 200 can be heated efficiently. Furthermore, because the heat of the inner support member 510 is transmitted through the guide members 540 and 550 and the outer support member 520, overheat of the inner support member 510 is avoided.

Figure 13:
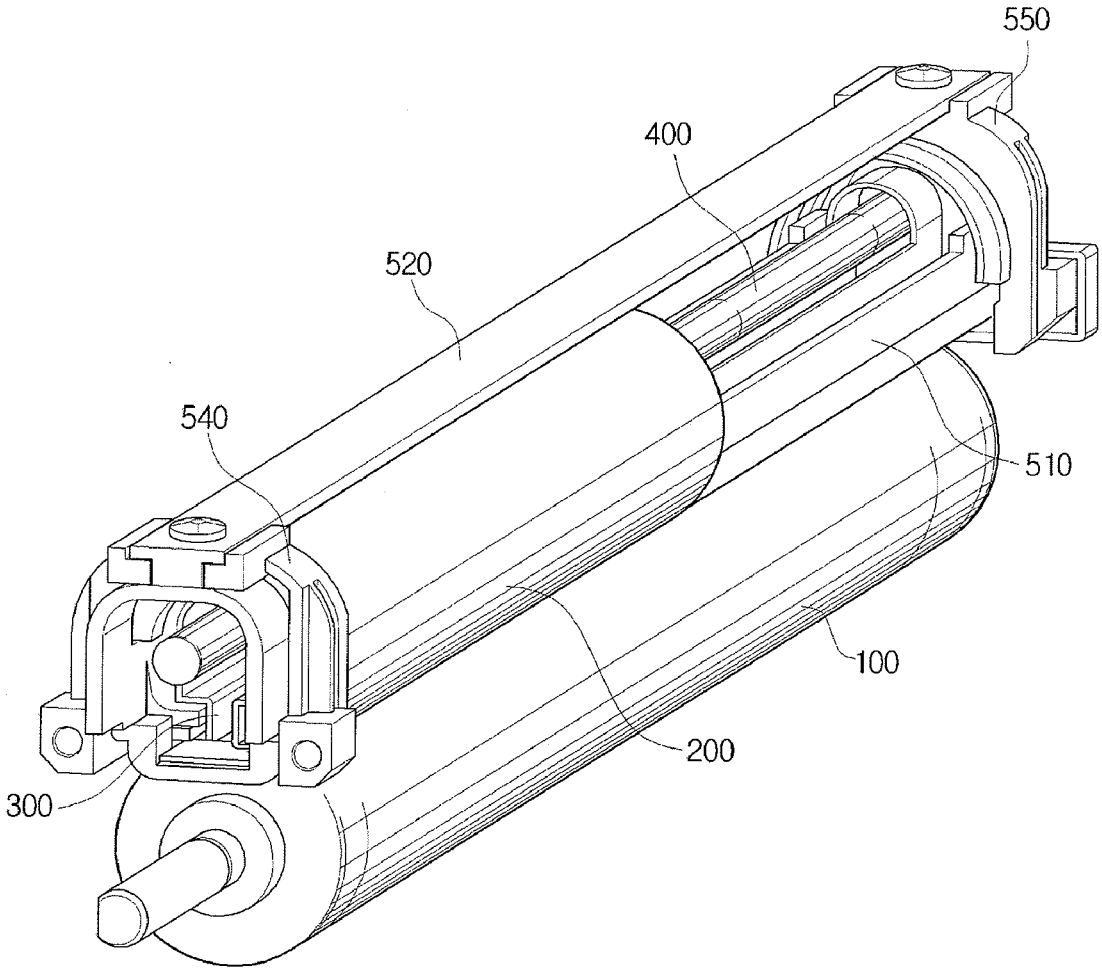
FIG. 13 is a perspective view illustrating both ends of a support unit of a fusing device in a fastened state according to another exemplary embodiment of the present general inventive concept.

FIG. 13 illustrates both ends of the inner and outer support members 510 and 520 of the support unit 500 in a fastening state according to another exemplary embodiment of the present general inventive concept.

Like the embodiment illustrated in FIG. 12, the inner and outer support members 510 and 520 according to the exemplary embodiment are fastened with the screws 530 and have the guide members 540 and 550 formed therebetween. However, both ends of the inner and outer support members 510 and 520 are in contact with each other in the exemplary embodiment. Such a structure reduces heat resistance by the belt guide members 540 and 550. Accordingly, more amount of radiation heat is transferred from the inner support member 510 to the outer support member 520, thereby preventing overheating of the inner support member 510 and subsequent deformation. The belt guide members 540 and 550 may be fixed at both ends of the inner and outer support members 510 and 520 separately.

Although not illustrated, a separate temperature sensor may be installed on an outer side of the belt unit 200 to measure the temperature of the support unit 500. This is to prevent overheating of the support unit 500 and subsequent deformation and inability to squeeze (push) the nip area uniformly along an axis direction parallel to a shat of the pressing unit 100. Additionally, a controller may be provided to control the heating of the heating unit 400 based on the temperature detected through the temperature sensor.

Figure 14:
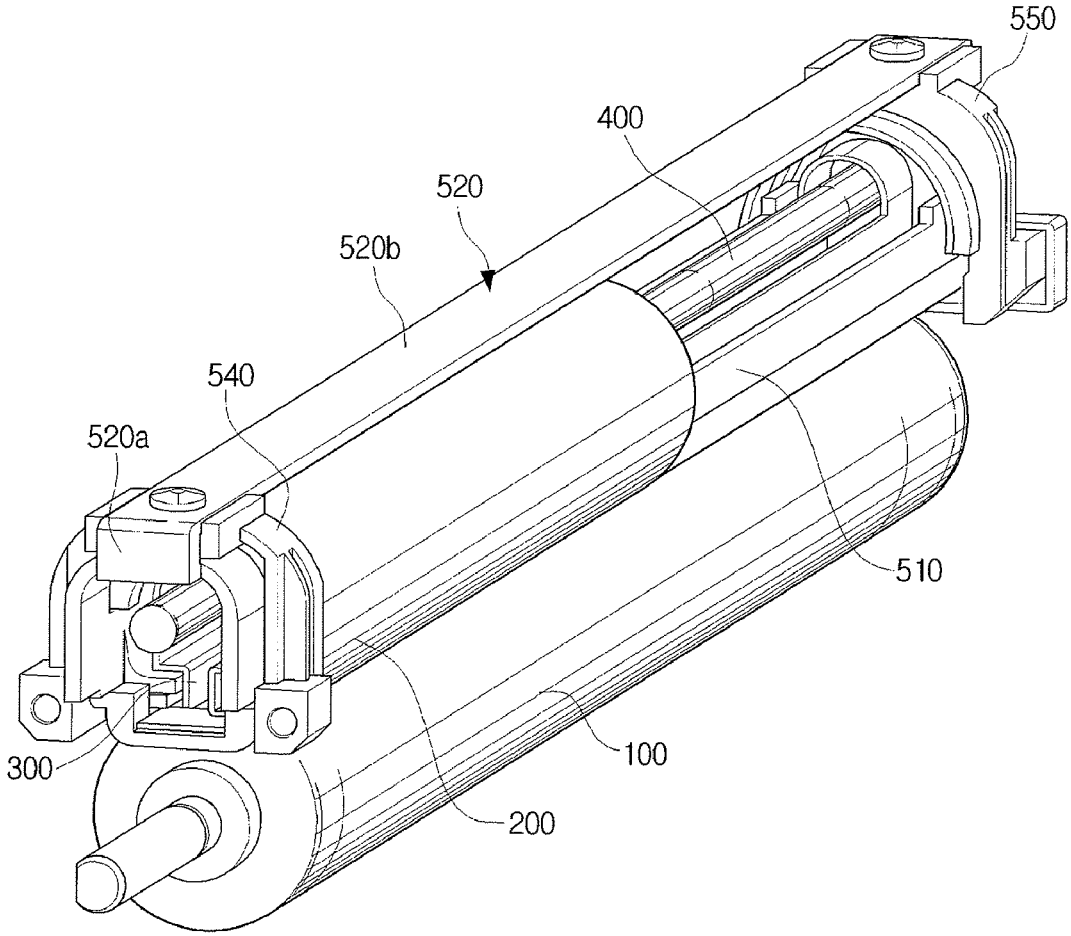
FIG. 14 is a perspective view illustrating both ends of a support unit of a fusing device in a fastened state according to yet another exemplary embodiment of the present general inventive concept.

FIG. 14 illustrates both ends 520*a* of the inner and outer support members 510 and 520 of the support unit 500 in a fastening state according to an exemplary embodiment of the present general inventive concept.

Like the embodiment illustrated in FIG. 12, the inner and outer support members 510 and 520 according to the second exemplary embodiment are fastened with the screws 530 and have the guide members 540 and 550 formed therebetween. However, the both ends 520*a* of the outer support members 520 are bent with respect to a major body 520*b* thereof to support both ends of the inner support member 510 according to the present exemplary embodiment. A predetermined degree of tension is applied to the support unit 500 according to characteristics of the support unit 500 to squeeze or push against the pressing unit 100 to form a nip area, and also according to spring force applied to the both ends 520*a* thereof. The both ends 520*a* of the outer support member 520 are bent to disperse a tensile load or stress exerted to the screws 530 and to help the inner and outer support members 510 and 520 and the belt guide members 540 and 550 be arranged in an assembling process. Because the both ends 520*a* of the inner and outer support members 510 and 520 are in contact with each other, the same effect is obtained as that from the exemplary embodiment illustrated in FIG. 13.

Figure 15:
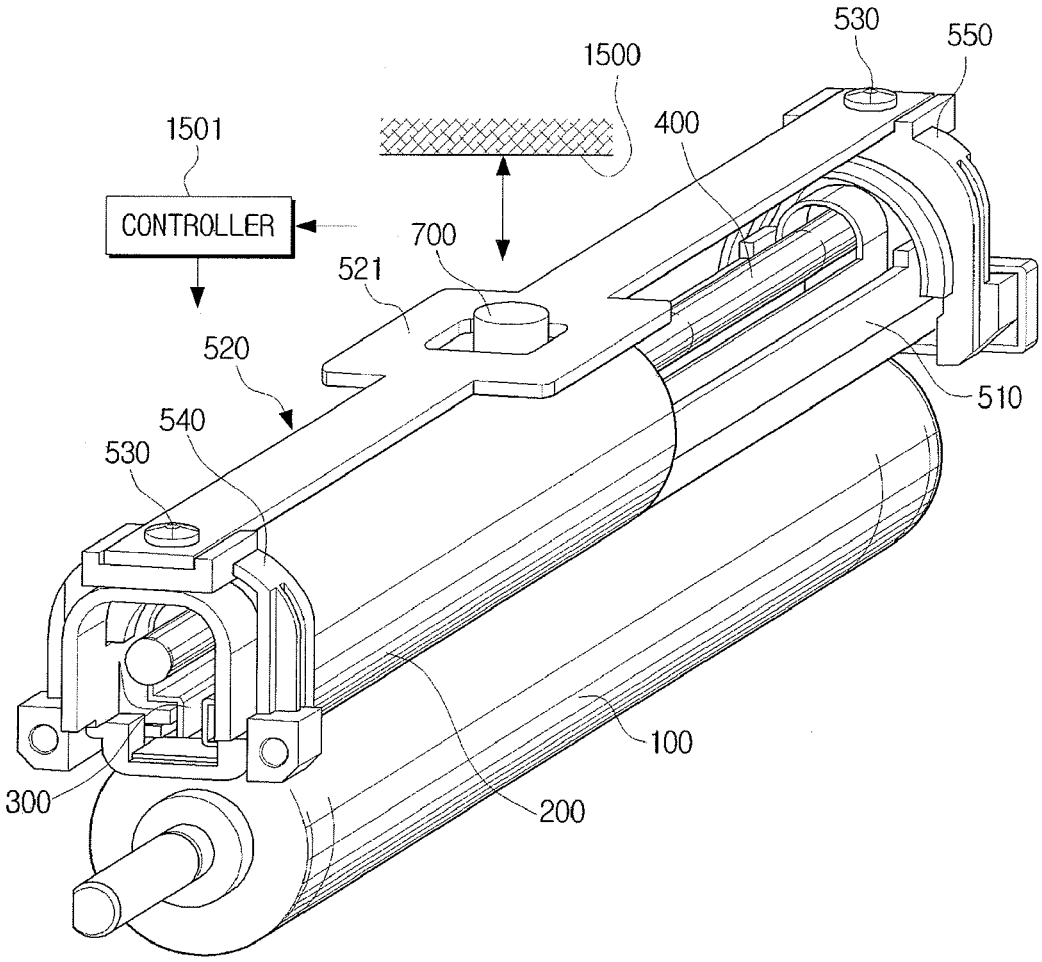
FIG. 15 is a perspective view illustrating a fusing device according to another exemplary embodiment of the present general inventive concept.

FIG. 15 is a perspective view of a fusing device according to yet another exemplary embodiment of the present general inventive concept.

According to an aspect of the exemplary embodiment, the outer support member 520 includes a space to install a thermostat 700 to detect a temperature, so that a controller 1501 can shut off the power to the heating unit 400 when overheat occurs. Accordingly, the thermostat 700 is formed on a cover 1500 of the fusing device to detect in a contact or non-contact manner a surface temperature of the belt unit 200, and the controller 1501 can shut off the power when detecting overheating. As a result, an unexpected abnormal operation can be prevented. FIG. 15 shows a temperature measure unit (hole) 521 formed on the outer support member 520 to accommodate the thermostat 700.

Other structural characteristics or effects of operation will be omitted for the sake of brevity, as these are same as those of the previous embodiments.

Figure 16:
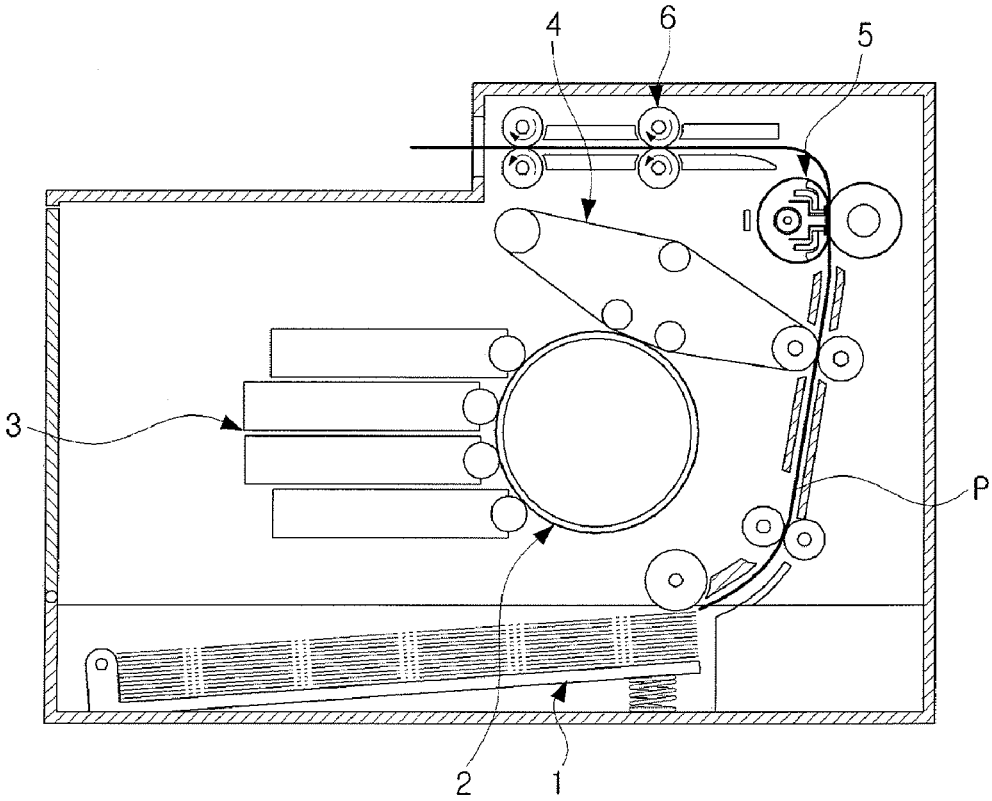
FIG. 16 is a cross-section view illustrating an image forming apparatus employing a fusing device according to an exemplary embodiment of the present general inventive concept.

FIG. 16 is a cross-section view illustrating an image forming apparatus employing a fusing device according to an exemplary embodiment of the present general inventive concept.

The image forming apparatus may include a feeding device 1, a photosensitive medium 2 to form an electrostatic latent image, a developing device 3 to develop the electrostatic latent image with a developer, a transfer device 4 to transfer the developer image from the photosensitive medium 2 onto a recording medium P, a fusing device 5 to fix the developer image into the recording medium P, and a paper discharge device 6.

The structure and operation of the feeding device 1, the photosensitive medium 2, the developing device 3, the transfer device 4, and the discharge device 6 will be omitted for the sake of brevity, as these are generally known. The fusing device 5 may have similar characteristics and structures as illustrated with reference to FIGS. 3 to 15. Here, the photosensitive medium 2, the developing device 3, the transfer device 4, and the discharge device 6 may be referred to as a printing unit to form an image on a printing medium, and the fusing unit 5 fixes the image onto the printing medium with at least one of pressure and heat.

A fusing device and an image forming apparatus according to the exemplary embodiments of the present general inventive concept ensures speedy printing with fast warm-up and stable heating, by directly heating the belt unit excluding the nip area with the heat of the heating unit, and thus reducing requirement for the heating unit of higher heat capacity, and utilizing the heat of the heating unit.

According to the exemplary embodiments of the present general inventive concept, the support unit supports the nip area of the nip forming unit uniformly along the axis direction, and also squeezes against the pressing unit, thereby preventing bending of the nip forming unit, and ensuring a stable nip width and improved fixability.

Furthermore, because an insulating member is provided to prevent the transfer of the heat from the nip forming unit to the support unit, the belt unit warms up faster at the nip area.

Furthermore, because the support unit has a predetermined degree of strength to squeeze the nip forming unit, and is formed not to obstruct the path of the radiation heat between the heating unit and the belt unit, belt unit is warmed up fast in the initial process.

Furthermore, because the support unit includes the inner support member formed within the belt unit, and the outer support member formed outside the belt unit, heat accumulated in the inner support member is radiated through the outer support member outside the belt unit. Because overheating and subsequent deformation is avoided, and nip width and pressure are stably maintained, fixability is improved.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A fusing device, comprising:

a pressing unit;

a belt unit to rotate in contact with the pressing unit;

a nip forming unit disposed to form a nip area on a contact area between the pressing unit and the belt unit;

a heating unit to generate a first radiation heat directed toward the nip forming unit and a second radiation heat directed toward the belt unit without being interrupted by the nip forming unit, a lower part of the belt unit being heated by the first radiation heat through the nip forming and an upper part of the belt unit being heated by the second radiation heat; and a support unit to support the nip forming unit with respect to the pressing unit, the support unit comprising an inner support member placed inside the belt unit and an outer support member placed outside the belt unit such that both ends of the outer support member are engaged with the inner support member to reinforce strength of the inner support member.

2. The fusing device of claim 1, wherein:

the pressing unit comprises a rotatable roller member; and the belt unit rotates by a rotating force transmitted from the roller member.

3. The fusing device of claim 1, wherein the nip forming unit comprises:

a main body formed to surround at least a portion of the heating unit to collect the first radiation heat from the heating unit; and a nip part connected to the main body to contact the belt unit.

4. The fusing device of claim 3, wherein the main body comprises a slit to allow a portion of the first radiation heat of the heating unit to be directly transferred to the nip part.

5. The fusing device of claim 3, wherein the main body and the nip part are formed in a single integral body.

6. The fusing device of claim 3, wherein the nip part comprises a portion to face the pressing unit and another portion to be curved to correspond to the shape of an outer circumference of the pressing unit.

7. The fusing device of claim 1, wherein:

the nip forming unit comprises a main body and a nip part; and the inner support member comprises a central portion comprising a pair of spaced ribs to press both sides of the nip part, and an arch-shape connector to connect both ends of each of the pair of spaced ribs.

8. The fusing device of claim 7, wherein the central portion further comprises reinforcing ribs bent toward an inner side of the pair of spaced ribs.

9. The fusing device of claim 7, wherein the inner support member comprises a plurality of spacers disposed between the pair of spaced ribs to keep the pair of spaced ribs at a predetermined distance from each other.

10. The fusing device of claim 1, wherein the support unit further comprises guide members provided on the both ends of the support unit to guide the traveling of the belt unit.

11. The fusing device of claim 10, wherein the guide members are fit in between arch-shape connectors of the inner support member and both ends of the outer support member and are fastened in place by screws respectively.

12. The fusing device of claim 11, wherein the both ends of the outer support member contact the arch-shape connector of the inner support member.

13. The fusing device of claim 11, wherein the both ends of the outer support member are bent and fastened.

14. The fusing device of claim 10, wherein the space of the support unit has a length to correspond to a length of the belt unit in a direction parallel to a rotating axis of the belt unit.

15. The fusing device of claim 7, further comprising:

an insulating member disposed between the nip part of the nip forming unit and a central portion of the inner support member to prevent transfer of heat of the nip forming unit to the support unit.

16. The fusing device of claim 15, wherein the insulating member comprises a portion to contract the belt unit and having a round shape to correspond to a traveling path of the belt unit.

17. The fusing device of claim 15, wherein the nip forming unit comprises a main body formed with a heat shielding part to prevent transfer of the first radiation heat of the heating unit to the inner support member and the insulating member.

18. The fusing device of claim 3, further comprising:

a thermostat formed on a cover of the fusing device to detect, by contact or without contact, a temperature of the belt unit and shut off power when detecting overheating, wherein an outer support member of the support unit comprises a hole to accommodate the thermostat to detect the temperature.

19. The fusing device of claim 1, wherein the inner support member is located inside the belt unit to press a nip part of the nip forming unit toward the pressing unit, and the outer support member is located outside the belt unit.

20. The fusing device of claim 19, further comprising:

an insulating member disposed between the inner support member and the nip forming unit to prevent transfer of heat from the nip part to the inner support member, wherein the insulating member comprises a surface to face the belt unit and to be round to correspond to a traveling path of the belt unit.

21. The fusing device of claim 19, further comprising:

guide members formed on both sides of the inner support member and the outer support member, to guide the traveling of the belt unit, wherein each of the guide members comprises a portion to be fit in between the inner support member and the outer support member and to be fastened in place by a coupling member.

22. An image forming apparatus comprising:

an imaging unit to form an image on a printing medium; and a fusing unit to fuse the image to the printing medium, wherein the fusing unit comprises:

a pressing unit;

a belt unit to rotate in contact with the pressing unit;

a nip forming unit disposed to form a nip area on a contact area between the pressing unit and the belt unit;

a heating unit to generate a first radiation heat directed toward the nip forming unit and a second radiation heat directed toward the belt unit without being interrupted by the nip forming unit, a lower part of the belt unit being heated by the first radiation heat through the nip forming and an upper part of the belt unit being heated by the second radiation heat; and a support unit to support the nip forming unit with respect to the pressing unit, the support unit comprising an inner support member placed inside the belt unit and an outer support member placed outside the belt unit such that both ends of the outer support member are engaged with the inner support member to reinforce strength of the inner support member.

* * * * *